US005661973A

United States Patent [19]

Casey

[11] Patent Number: 5,661,973

[45] Date of Patent: Sep. 2, 1997

[54] MUFFLER AND FUEL SAVING DEVICE FOR INTERNAL COMBUSTION DIESEL ENGINE

[76] Inventor: Russell A. Casey, 1010 E. Thompson St., Sapulpa, Okla. 74066

[21] Appl. No.: 546,981

[22] Filed: Oct. 23, 1995

[51] Int. Cl.[6] ..... F02M 25/06

[52] U.S. Cl. ..... 60/279; 181/270

[58] Field of Search ..... 60/279, 280; 181/265, 181/270, 272, 281

[56] References Cited

U.S. PATENT DOCUMENTS

| | | | |
|---|---|---|---|
| 2,325,543 | 7/1943 | Redinger | 60/279 |
| 2,584,674 | 2/1952 | Da Costa | 60/279 |
| 4,172,508 | 10/1979 | Moss et al. | 181/270 |
| 4,220,219 | 9/1980 | Flugger | 181/265 |
| 4,628,689 | 12/1986 | Jourdan | 181/270 |
| 5,245,140 | 9/1993 | Wu | 181/272 |

*Primary Examiner*—John T. Kwon

[57] ABSTRACT

An improved muffler and energy saving device for diesel engines comprising a housing having an inlet passageway for admitting gases into the interior of the housing and an outlet passageway for discharging gases from the housing, an alcove, near the entrance of the housing, to capture unburned components from the exhaust stream which are returned to the air induction manifold of the engine. Baffles disposed within the housing break up the exhaust pulses to reduce sound emission while permitting the free flow of exhaust gases between the inlet and outlet ports of the muffler. The muffler creates negligible internal back pressure due to the large passageways provided and is therefore not subject to the problems associated with plugging or clogging.

6 Claims, 2 Drawing Sheets

MUFFLER AND FUEL SAVING DEVICE FOR INTERNAL COMBUSTION DIESEL ENGINE

BACKGROUND OF THE INVENTION

The present invention relates to improvements in mufflers or silencers for internal-combustion engines of the diesel variety, wherein the heat-of-compression causes the ignition of fuel-oil directly injected into the combustion chambers of said engines, and more particularly to a muffler comprising means to more effectively silence exhaust pulses; reduce back-pressure within the exhaust system; recover unburned fuel from the exhaust stream and; improve overall engine efficiency.

The depletion of the major portion of domestic petroleum reserves and the resultant increase in the cost of imported petroleum-based hydrocarbon fuels, such as those employed in internal-combustion engines of the diesel variety, has created the economic requirement to conserve energy and extract the maximum amount of energy from each gallon of fuel consumed. Further, the adverse effect upon the quality of the atmosphere, as well as the perceived deterioration of the Earth's protective ozone layer, has brought about an urgent environmental requirement to reduce the discharge of noxious airborne contaminants and particulate matter which are the products of combustion of such fuels. Additionally, the multiple explosions occurring within the cylinders of these internal-combustion engines must be silenced or muffled before they are released into the atmosphere lest they contribute to yet another environmental problem, noise pollution.

Attempts to find individual solutions to these problems often creates additional, and more complex problems for example, conventional exhaust silencers employ a multiplicity of small holes to accomplish their purpose. In a new condition these mufflers perform well. However, in use the small holes tend to become partially blocked by particles of carbon and rust, retarding the passage of the exhaust stream, increasing the back-pressure within the exhaust system and causing the engine to "breath" poorly. This results in poor fuel economy, degraded performance, increased emission of noxious fumes, gasses and particulate matter, and ultimately in the failure of exhaust valves and other engine parts.

A number of previous disclosures found in the prior art have addressed these problems. Among those disclosures, found in the patent literature of the United States, are the following: U.S. Pat. No. 3,498,406 by Heath; U.S. Pat. No. 3,733,827 by Zuzuki; U.S. Pat No. 3,799,133 by Frank; U.S. Pat. No. 3,842,808 by Cataldo; U.S. Pat. No. 4,087,966 by Akado and; U.S. Pat. No. 4,333,440 by Eheim. Unfortunately, the developments by these inventors do not appear to have seen wide commercialization or acceptance by the automotive industry, and as a consequence, neither the public nor the environment have derived a measurable benefit from their efforts.

SUMMARY OF THE INVENTION

The present invention relates to improvements in exhaust mufflers, or silencers, for internal-combustion diesel engines and comprises an energy saving device incorporated therein to provide a combination muffler specifically designed for reducing back pressure in the exhaust system, and an energy saving device, for increasing the efficiency of the engine through the recovery and recycling of unburned fuel.

The current state-of-the-art in diesel engine mufflers directs the exhaust stream through a plurality of small openings or ports within the muffler housing, which upon long-term use, frequently become clogged with rust, carbon and the like. The efficiency of such mufflers, that have been thus clogged, is severely reduced. Restriction of the free passage of the exhaust gasses results in increased back-pressure within the engine exhaust system causing a reduction in the horsepower output of the engine; an increase in cylinder head temperature, frequently resulting in early exhaust valve failure, and; a reduction in upper cylinder lubrication resulting in accelerated piston ring wear. In response to the reduction in horsepower output, the engine operator compensates by opening the throttle to a greater degree, thereby causing the injection of a greater amount of fuel and compounding the problem by over-fueling the engine, causing, to no avail, a greater consumption of fuel, frequently burning holes in the tops of the pistons which often results in catastrophic engine failure. As a result of over-fueling the exhaust smoke becomes darker and more dense as greater amounts of particulate matter and unburned fuel are discharged into the atmosphere to contribute to environmental pollution. Diesel engine mufflers of the current state-of-the-art do not incorporate means, within the muffler body, for the entrapment and recovery of unburned fuel.

The present invention contemplates a novel muffler and fuel saving device for overcoming the aforesaid disadvantages of state-of-the-art mufflers and fuel saving devices. This novel combination muffler and fuel saving device comprises a housing having an inlet port extending thereinto for admitting exhaust gasses, and an outlet port for discharge of the exhaust gasses therefrom. The housing provides an unrestricted passageway for the exhaust gasses which greatly exceeds the cross-sectional area of either the inlet or the outlet pipes and provides a series of expansion chambers therebetween thus relieving the creation of any back pressure during the operation of the engine. An alcove or chamber provided near the muffler inlet entraps gasses containing unburned fuel, which are directed out of the exhaust stream to pass through a filter and returned to the air induction manifold of the engine for the recovery of any residual energy entrained therein.

Baffle means, secured within the housing and interposed between the inlet and outlet of the muffler, direct the path of the exhaust stream through the housing with the effect of changing the direction of the flow of gases a number of times between the inlet and outlet pipes thereby providing a greater distance for the exhaust gasses to travel and be subjected to the silencing effect of expansion prior to being discharged into the atmosphere.

DESCRIPTION OF PREFERRED EMBODIMENT

Figure 1:
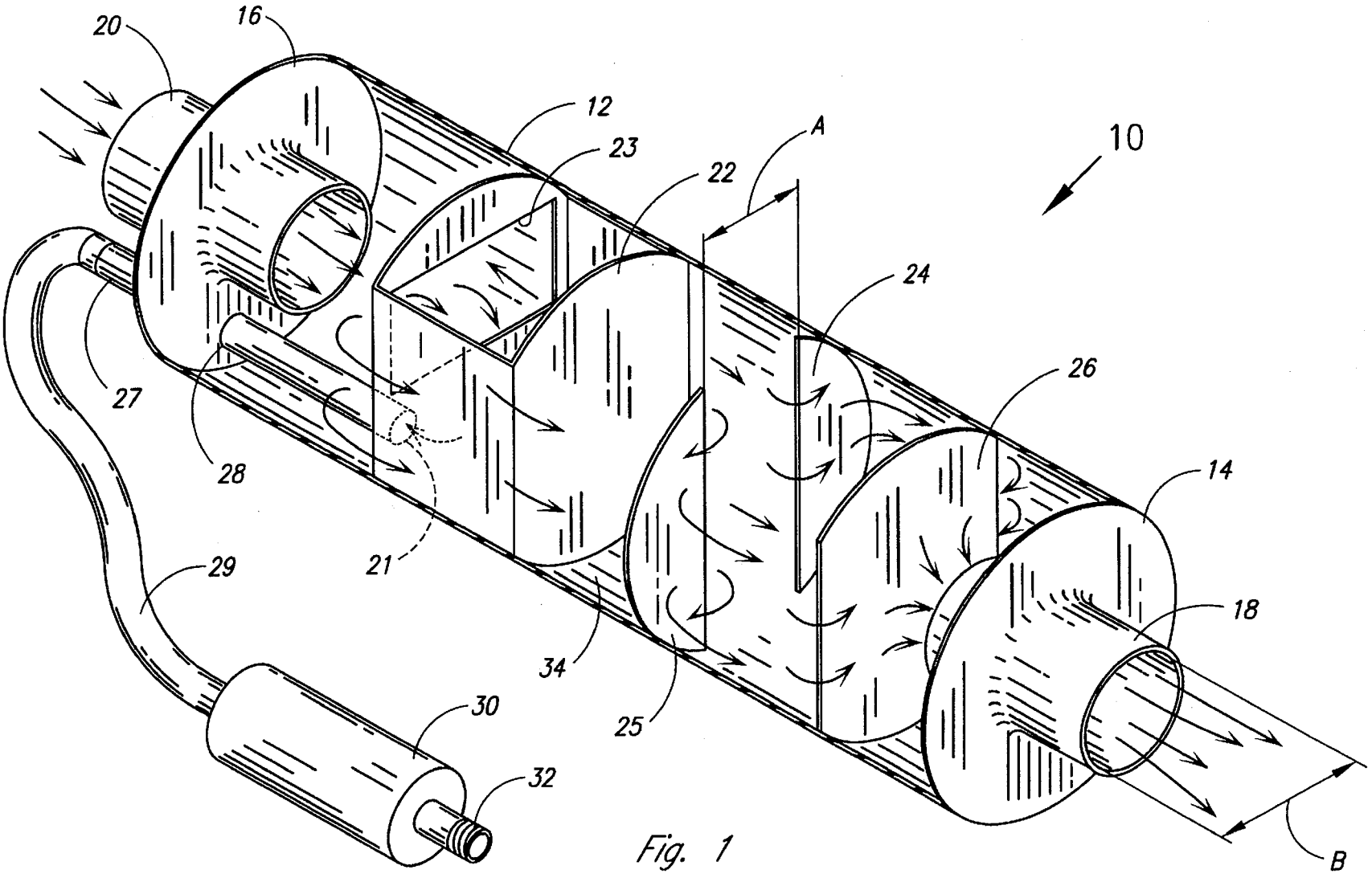
FIG. 1 Illustrates, in cutaway isometric view, the placement of the various parts in the interior of the muffler and indicates the flow pattern of the gasses from inlet to outlet. This illustration depicts the muffler rotated 90° from the normal operating position with the bottom of the muffler facing the viewer.
Figure 2:
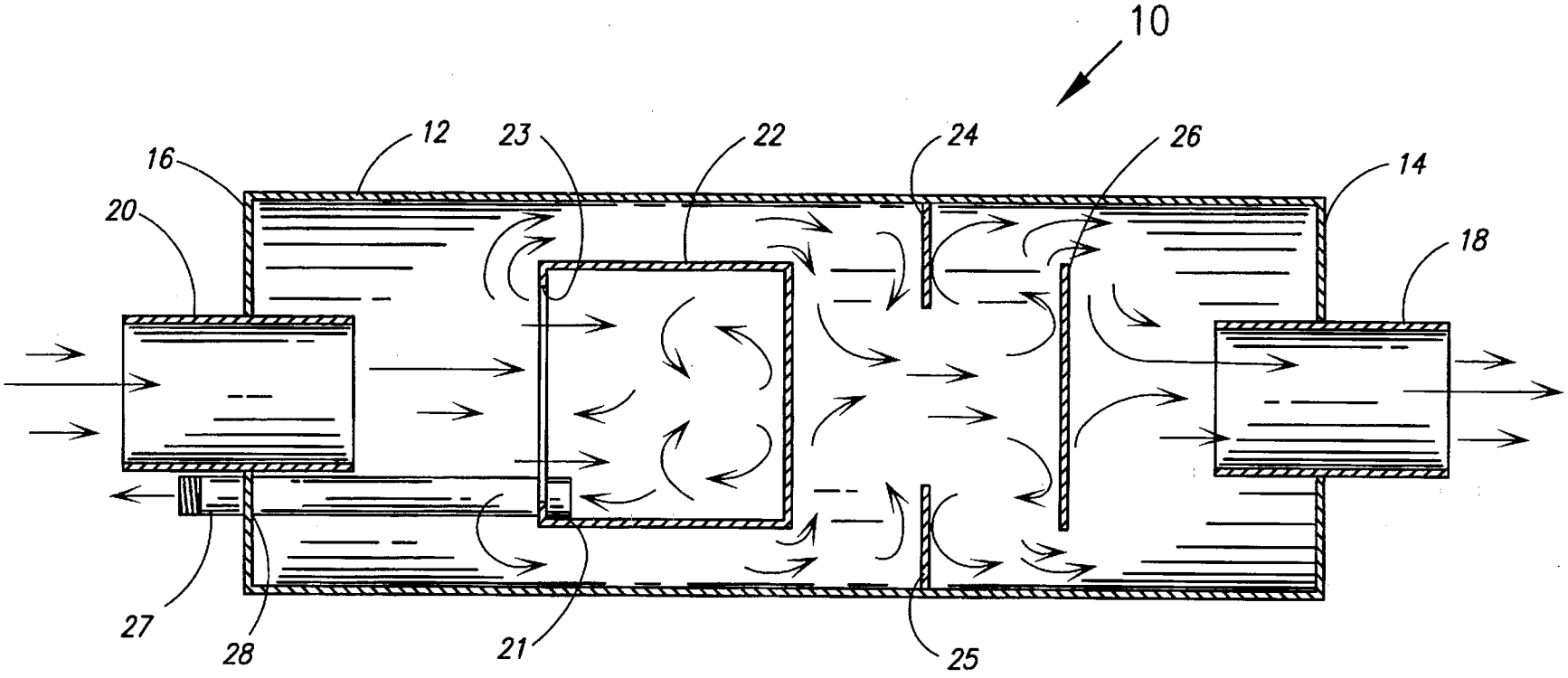
FIG. 2 Illustrates in sectionalized view, the fuel recovery alcove or chamber, the recovery pipe, the placement of the baffles, and emphasizes the volume available for expansion of the exhaust stream.

Referring now to FIGS. 1 and 2, there is illustrated the preferred embodiment of a combination muffler and fuel saving device 10, of a metallic construction, configured for attachment to the exhaust "head" pipe of a diesel-type internal-combustion engine, consisting of an elongated cylindrical housing 12, of a diameter at least three times greater than that of entry pipe 20, having entry end plate 16 and discharge end plate 14, fixedly attached by welding, crimping or any other appropriate means to the opposing ends of said housing 12. Entry pipe 20 and discharge pipe 18 extend through centralized bores in their respective end plates 16 and 14 and are fixedly attached thereto by welding, crimping, rolling or any other suitable means. It is to be noted that said entry pipe 20 and said discharge pipe 18 extend inwardly toward the longitudinal center of housing 12, for a distance equivalent to their respective diameters, from their point of attachment with their respective end plates. Spaced apart, from the inner end of the entry pipe 20 at a distance of one and one-half times the diameter of said entry pipe, and fixedly attached by welding, riveting or other suitable means to the interior wails of housing 12 is an alcove or recovery chamber 22, comprising a planar front wall, in which there is provided a rectangular aperture 23, having a cross-sectional area two and one-half times greater than that of entry pipe 20, facing said entry pipe, a planar back wall, a planar ceiling and a planar floor. The side walls of said recovery chamber are provided by the interior surface of the circumferential wall of housing 12 which also serves to support said chamber centrally within said housing where it is fixedly attached by the previously stated means. FIG. 2 clearly depicts the space allowed above and below recovery chamber 22 to allow the unrestricted flow of exhaust gasses passing above and below said chamber. Adjacent the floor or bottom 21 of said chamber 22, and parallel therewith, is recovery pipe 27 which traverses the front wall of said chamber and extends outwardly in the direction of entry pipe 20, to traverse entry end plate 16, at location 28 and extends a short distance therebeyond where it terminates and is provided with a male pipe thread, said recovery pipe 27 being fixedly attached at the points of traverse of both entry end plate 16 and the front wall of recovery chamber 22 by weldments or other suitable means of attachment. One end of a formable return tube 29, constructed of a suitable material, is attached to the external end of recovery pipe 27, and the distal end thereof is connected to a filter 30, of a metallic or other suitable construction, having either a disposable media or a cleanable filtration element having the equivalency of a 120 mesh screen. The distal end of said filter is provided with a connection 32, to which there is attached an additional length of suitable tubing (not shown) which is connected at the distal end thereof to the inlet side of the engine turbo-supercharger, or to the air induction manifold in the case of of a naturally aspirated engine. Also illustrated in FIG. 1 at A is the inter baffle spacing between segmental baffles 24 and 25 which provides an area for the passage of the exhaust stream equivalent to two and one-half times the area of either inlet pipe 20 or discharge pipe 18 at B. Continuing along the length of the muffler as depicted in FIG. 2, it will be seen that planar segmental baffles 24 and 25, conforming with the inner circumference of housing 12 are attached in perpendicularity to said inner circumference by weldment, rivets or other appropriate means, to the interior of said housing at the top and bottom thereof. Said segmental baffles being in a longitudinally spaced-apart relationship from the rear wall of recovery chamber 22 at a distance equal to the diameter of entry pipe 20. Continuing along the length of the muffler, it will be seen that a central transverse baffle 26, a replication of the rear wall of recovery chamber 22, is situate in horizontal transverse of housing 12, in a longitudinally spaced-apart relationship from peripheral baffles 24 and 25 at a distance equal to the diameter of entry pipe 20 and at a distance from the inlet end of discharge pipe 18 equal to one and one-half times the diameter of entry pipe 20, where it is fixedly attached in the same manner as the said segmental baffles. Discharge pipe 18, which extends into the muffler body for a distance equal to the diameter of said pipe, passes through and is fixedly attached by welding, rolling or other suitable means in a central bore in discharge end plate 14. Said discharge pipe passes outwardly of said discharge end plate for a distance sufficient to conveniently attach, in the conventional manner, such appurtenant piping as may be required to bring the exhaust discharge to the desired location.

OPERATION

In operation, inlet end pipe 20 is connected in the conventional manner to the "head" pipe of the exhaust system of a diesel type internal combustion engine and the discharge end pipe 18 is, in a like manner, connected to an exhaust or "tail" pipe. Recovery pipe 27 is connected to return tube 29, which passes to filter 30, and thence by way of a supplemental tube from connection 32 to the air induction system of a diesel engine (not shown). When the diesel engine is in operation the exhaust gasses enter the muffler through said entry pipe, at which point said gasses begin to expand. The heavier components in the exhaust stream, which frequently contain residual or unburned fuel are projected into said recovery alcove or chamber where said residual fuel, being heavier, falls to the floor of said chamber where it is attracted by an area of lower pressure created by the vacuum produced by the induction system of the engine, and is drawn into said recovery pipe, thence through said filter, which traps particulate matter, and thence to the induction system of the engine and ultimately into the combustion chambers where any remaining residual energy is extracted. The non-energy bearing exhaust gasses continue onward through the muffler, around the top and bottom of the recovery chamber to a confrontation with the said segmental baffles which change the direction of the exhaust stream and allow the further silencing effect of expansion to act upon them. Expansion continues as the gasses encounter a central baffle where their direction is again changed as the expansion continues. Passing around said central baffle, a portion of the expanding, and now greatly decelerated exhaust gasses strike the discharge end plate completing expansion and again reversing direction before joining the portion of said gasses which have proceeded directly to the inlet end of said discharge pipe where a silenced and cleaned exhaust is passed through the "tail" pipe into the atmosphere, thus achieving the objectives of the present invention: the recovery of the residual energy from incompletely burned fuel; the more efficient operation of diesel engines by reduction of back-pressure in the exhaust system; the reduction of particulate emissions and; a reduction in the exhaust sound levels emitted by diesel engine operated equipment, all of which contribute to a cleaner, quieter environment.

As the muffler of the present invention is applicable to engines of a wide range of displacement, horsepower, rotational speed, and service (e.g., highway transport, electric power-generation, earth moving, etc.), the diametric dimension of entry end pipe 20 is based upon the engine manufacturers specification for each engine model and type of service, and is the basis for all other dimensions, measurements and ratios. It is to be noted that in all instances, the cross sectional areas of all internal passages of the present invention equal not less than 2.5 times that of the cross-sectional area of entry pipe 20 or discharge pipe 18, thus obviating the problems associated with the obstruction of a multiplicity of small diameter holes. It is to be further noted that the 2.5 to 1 ratio herein stated is the result of experimentation during the reduction-to-practice of the present invention, and is not to be construed as limiting or restrictive. The number of baffles illustrated and described herein are to be considered as the minimum required for illustration and descriptive purposes. It is therefore to be understood that additional sets of baffles may be employed in an elongated housing, to achieve enhanced silencing.

Whereas the present novel invention has been described in particular relation to the drawings attached hereto it should be understood that other and further modifications, apart from those shown or suggested herein may be made within the spirit and scope of the appended claims.

What I claim is:

1. An improved muffler and fuel saving device for internal-combustion engines, and more specifically, internal-combustion engines of the diesel variety, comprising in combination:

a. elongate cylindrical muffler housing means;

b. entry end-plate means providing closure of the entry end of said muffler housing means;

c. discharge end-plate means providing closure of the discharge end of said muffler housing means;

d. entry-end pipe means traversing said entry end-plate providing an entry for exhaust gasses;

e. discharge-end pipe means traversing said discharge end-plate providing an exit for exhaust gasses;

f. recovery chamber means for the entrapment and recovery of unburned fuel said recovery chamber having a recovery pipe which passes to the exterior of said muffler to connect a return tube for returning exhaust gas to the engine;

g. return tube means for the return of said recovered unburned fuel to an air induction system of the engine;

h. filter means located within said return tube for the removal of particulate matter from recovered unburned fuel;

i. peripheral segmental baffle means within said muffler housing, and;

j. central transverse baffle means within said muffler housing.

2. The muffler and fuel saving device as claimed in claim 1 wherein said elongated cylindrical muffler housing means has a diameter at least three times greater than the diameter of said entry-end pipe means.

3. The muffler and fuel saving device as claimed in claim 1 wherein the forward wall of said recovery chamber means comprises a rectangular opening having an area at least two and one-half times greater than that of the diametric area of said entry pipe means.

4. The muffler and fuel saving device as claimed in claim 1, wherein at lease one pair of peripheral segmental baffles attached to the inner circumference of the said muffler housing for directing flow of the exhaust gas stream.

5. The muffler and fuel saving device as claimed in claim 1, wherein at lease one centralized transverse baffles attached to the inner circumference of the said muffler housing for reacting to the exhaust stream caused by the segmental baffles to provide additional breaking up of the exhaust stream and to provide additional expansion prior to the release of the exhausted gasses into the atmosphere.

6. The muffler and fuel saving device as claimed in claim 1, wherein the cross-sectional area of all internal passages within said muffler housing are a minimum of two and one-half times the cross-sectional area of said discharge end pipe.

* * * * *